US005823218A

United States Patent [19]

Schlecht et al.

[11] Patent Number: 5,823,218

[45] Date of Patent: Oct. 20, 1998

[54] LARGE MANIPULATOR, ESPECIALLY FOR SELF-PROPELLED CONCRETE PUMPS, AND METHOD FOR OPERATING IT

[75] Inventors: Karl Schlecht; Hartmut Benckert, both of Filderstadt, Germany

[73] Assignee: Putzmeister Aktiengesellschaft, Aichtal, Germany

[21] Appl. No.: 605,081

[22] PCT Filed: Jul. 26, 1994

[86] PCT No.: PCT/EP94/02460

§ 371 Date: Feb. 23, 1996

§ 102(e) Date: Feb. 23, 1996

[87] PCT Pub. No.: WO95/06178

PCT Pub. Date: Mar. 2, 1995

[30] Foreign Application Priority Data

| | | | |
|---|---|---|---|
| Aug. 26, 1993 | [DE] | Germany | 43 28 707.7 |
| Apr. 13, 1994 | [DE] | Germany | 44 12 643.3 |

[51] Int. Cl.[6] ..... B67D 5/64

[52] U.S. Cl. ..... 137/1; 137/615; 91/363 R; 141/387

[58] Field of Search ..... 91/363 R; 137/615, 137/1; 141/387

[56] References Cited

U.S. PATENT DOCUMENTS

| | | | |
|---|---|---|---|
| 3,944,798 | 3/1976 | Eaton | 235/151.3 |
| 3,986,007 | 10/1976 | Runofet, Jr. | 235/151.1 |
| 4,156,835 | 5/1979 | Whitney et al. | 318/561 |
| 4,185,280 | 1/1980 | Wihelm | 340/685 |
| 4,187,454 | 2/1980 | Ito et al. | 318/568 |
| 4,205,308 | 5/1980 | Haley et al. | 137/615 |
| 4,323,975 | 4/1982 | Ball | 141/387 |
| 4,844,685 | 7/1989 | Sasaser | 91/363 R |
| 4,901,624 | 2/1990 | Feuser | 91/363 R |
| 5,535,780 | 7/1996 | Schlecht et al. | 137/615 |
| 5,640,996 | 6/1997 | Schlecht et al. . | |
| 5,720,069 | 2/1998 | Wanner et al. . | |

FOREIGN PATENT DOCUMENTS

| | | |
|---|---|---|
| 26 40 033 | 1/1978 | Germany . |
| 28 35 712 | 2/1980 | Germany . |
| 33 11 736 | 10/1984 | Germany . |
| 38 10 054 | 10/1989 | Germany . |
| 39 11 677 | 10/1990 | Germany . |
| 42 02 505 | 8/1993 | Germany . |
| 1129067 | 12/1984 | Russian Federation . |
| 1664544 | 7/1991 | Russian Federation . |

OTHER PUBLICATIONS

Drawings from U.S. Ser. No. 08/713 339 filed Sep. 30, 1996 (Atty Ref: Wolf and Lutz Case 67)—1 sheet.

*Primary Examiner*—A. Michael Chambers
*Attorney, Agent, or Firm*—Flynn, Thiel, Boutell & Tanis, P.C.

[57] ABSTRACT

A large manipulator, especially for self-propelled concrete pumps includes a rotary head that rotates about a vertical axis on a mast stand, and a jointed or articulated mast composed of at least three mast arms. The mast arms of the jointed mast can be swivelled to a limited extent about horizontal, mutually parallel axes relative to the adjoining rotary head or mast arm using a corresponding drive unit in each case. The jointed mast is operated by a remote control device which has a signal transmitter situated at the mast top and a control unit. The signal transmitter drives a computerized coordinate field device actuating the drive units according to a displacement path relative to the momentary position of the mast top as directly indicated by means of the control unit.

30 Claims, 5 Drawing Sheets

50
55
62
52,53
70
72
72'
72''
74
76
78
80
82
84

LARGE MANIPULATOR, ESPECIALLY FOR SELF-PROPELLED CONCRETE PUMPS, AND METHOD FOR OPERATING IT

FIELD OF THE INVENTION

The invention relates to a large manipulator, especially for self-propelled concrete pumps, having a rotary head rotatable about an essentially vertical axis of rotation by means of a driving system and arranged on a frame, especially a chassis; a jointed mast composed of at least three mast arms and preferably designed as a concrete-distributing mast, which mast arms are pivotally limited about horizontal, mutually parallel joint axes relative to the respectively adjacent rotary head or mast arm by means of a further driving system. The further driving system has a remote-control device. The remote-control device has a control member for controlling the driving system and for adjusting the mast top, which preferably carries an end hose, along a displacement path. The invention relates further to a method for operating the large manipulator.

BACKGROUND OF THE INVENTION

Self-propelled concrete pumps of this type are mobile tools, which with a full 360° swivelling range of the rotary head can also be utilized when the jointed mast is in an extended horizontal position. The operator is responsible for the control of the self-propelled concrete pump and the positioning of the concrete end hose on the last arm of the jointed mast. He must operate more than three rotatoric degrees of freedom of the jointed mast through the associated driving systems while moving the jointed mast in a non-structured three-dimensional work space, while closely monitoring the building-site border conditions. By using proportional-radio telecontrols this operation was made easier since the operator is no longer encumbered with a cable attached to the self-propelled concrete pump. However, the risk that during a single-axis operation uncontrolled movement at the end hose continues, thusly endangering the building-site personnel. Furthermore, a quick correctional movement of the end hose requires a simultaneous control of several axes. In the past, a single control was required for each of the rotatoric degrees of freedom of the jointed mast. It has already been suggested in order to ease the handling of the large manipulator, to move the end hose through a suitable calculator support in a cartesian x-, y-, z-coordinate system with the help of switch levers, whereby a frame-fixed or building-site-fixed coordinate system can be selected. ("Computer controlled concrete distribution", Dr.-Ing. Hartmut Benckert, Putzmeister-Werk, Seiten 111–119, 8th Int. Symposium on automation and robotics, IPA (FHG) Stuttgart 1991). However, this type of operation has not proven to be rationally sufficient for many uses since the operation of the switch levers needed for this cannot always be precisely synchronized with the optically recognizable sequences of movement of the jointed mast.

Starting out from this the basic purpose of the invention is to improve the conventional large manipulator of the above-disclosed type in such a manner that it is possible for the operator to control any desired points within the area of the reach of the jointed mast by simple manipulations directly from the concrete-feeding point.

SUMMARY OF THE INVENTION

The basic thinking for the solution of the invention is that the operator easily directs the end hose manually toward the concrete-feeding point and that the mast top automatically follows it. A suitable signal-transmitting path is needed for this, with which the mast top can be moved by the operator with a computer assistance over a displacement path preferably specified by the end hose. In order to achieve this, the invention provides that the remote-control device has a signal transmitter, which is arranged at the mast top and can be mechanically, optically, electromagnetically or electrically released through the control member, for controlling a computer-assisted coordinate transmitter, which operates the driving systems of the jointed axes and axes of rotation in accordance with a displacement path directly indicated by means of the control member relative to the instantaneous position of the mast top.

According to a preferred development of the invention, the control member is designed as a control lever, which is mechanically connected to the signal transmitter and is adjustable relative to the mast top in various directions indicating the displacement path, and which control lever can be operated, for example, through a sensor ring, a rope or a rod, and can also be mechanically connected to the movable end hose and grips around same with a certain play.

As an alternative to this it is possible that the control member and the signal transmitter are connected with one another by a direction-sensitive wireless transceiver path, for example by a light, infrared or radio path, whereby a transmitter provided in the hand or on the helmet of the operator can be used as the control member. A signal emitted by this transmitter in an upward direction, preferably in the form of a narrow directional cone, can be received by the direction-sensitive receiver arranged in the area of the mast top and can be converted through a suitable evaluating electronics and the coordinate transmitter into the desired movement of the jointed mast. For this purpose, the transmitter can also contain a Laser diode and the receiver a direction-sensitive light receiver.

A preferred development of the invention provides that the control member is designed as a direction-sensitive inclination indicator, which is preferably releasably and/or elevationally adjustably arranged on the movable end hose. The direction sensitivity can become reality, for example, through the use of a biaxial inclination indicator. The inclination indicator has evaluating electronics with an integrated or following signal transmitter for emitting a displacement-path signal depending on the measured direction of the inclination and/or a speed signal depending on the measured angle of inclination for the movement of the mast top. The inclination indicator preferably together with the signal transmitter can be arranged in a housing, which can be fixedly fastened against rotation relative to the mast top on the end hose. Based on this measure, it is possible to move the mast top during the deflection of the end hose into a direction corresponding with the direction of deflection with a speed dependent on the deflection or inclination angle.

The large manipulator can be particularly easily handled with the inclination indicator of the invention when a handle is provided on the end hose. The handle is arranged pivotally about the hose axis and/or about an axis extending transversely with respect to the hose axis. The handle has for handling by both hands, advantageously, two handle parts projecting toward diametrically opposite sides of the end hose. The handle is suited additionally for mounting of switch or control elements, for example, for switching the concrete pump on or off and/or adjusting the amount to be transported and/or for lifting and lowering the mast top. In order to avoid an unintended movement of the mast top, it is possible to design in addition one of the switch elements as a dead-man switch.

The driving systems of the jointed mast and of the mast base are, for reasons of safety of operation, combined and controlled through the coordinate transmitter, while advantageously maintaining the height of the mast top in a specified horizontal plane. The improvement here is that the mast top follows the signal transmitter in such a manner that it always remains approximately vertical at a certain elevational distance above the operator and follows at a specified minimum deflection of the end hose of, for example, ±50 cm. To adjust the height of the mast top, it is possible to additionally provide a manually operated elevation-adjusting element. The elevation-adjusting element can have, for example, a speed-controlled double-throw switch with a defined zero position, which switch reacts to a lifting and lowering force engaging the control member.

It is particularly advantageous when the speed of movement of the mast top can be controlled in accordance with the deflection range of the control member in a displacement direction relative to a zero position.

To optimize the sequence of movement during the horizontal and/or vertical adjustment, it is important that the driving systems of the redundant joint axes of the jointed mast can be operated in accordance with a selected predetermined path-swivel characteristic. Since the mast arms depending on their alignment relative to the gravitation axis, on the one hand, and on the load engaging said arms (for example concrete in the feed pipe), on the other hand, are subjected to more or less great bending and torsion loads, which loads adulterate the position of the mast top at specified swivel positions in the individual joints, it is suggested according to a preferred development of the invention, that the path-swivel characteristic in the coordinate transmitter be modified in accordance with the load-dependent bending and torsion moments engaging the individual mast arms. The same applies when, in order to avoid collisions in the moving space of the jointed mast, obstacles must be overcome. It is here advantageous to modify the swivel path characteristic of the joint axes in the coordinate transmitter in accordance with collision zones spatially limiting the mast-arm movements, in particular by indicating a highest and/or lowest bending point. A further security in this respect is achieved when the swivel path characteristic of the joint axes in the coordinate transmitter can be modified in accordance with measuring signals emitted by a distance sensor, preferably arranged on the last mast arm.

BRIEF DESCRIPTION OF THE DRAWINGS

The invention will be discussed in greater detail hereinafter in connection with exemplary embodiments schematically illustrated in the drawings, in which.

DETAILED DESCRIPTION OF THE INVENTION

Figure 1:
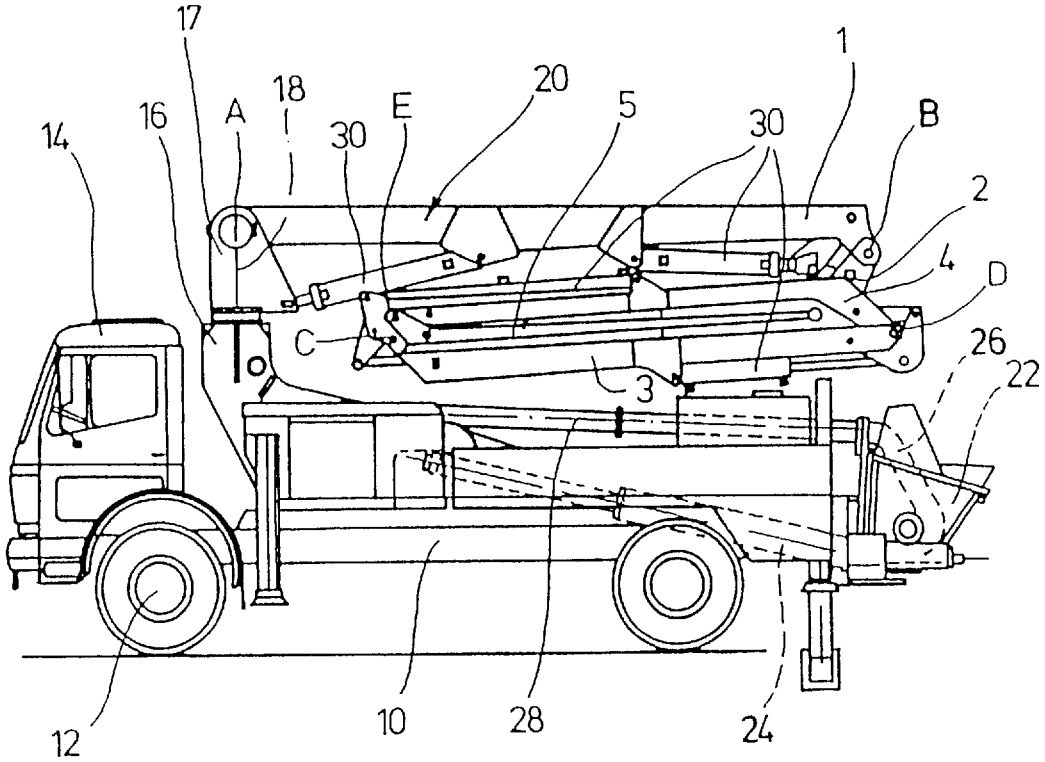
FIG. 1 is a side view of a self-propelled concrete pump with a five-arm jointed mast in a collapsed state.
Figure 2A:
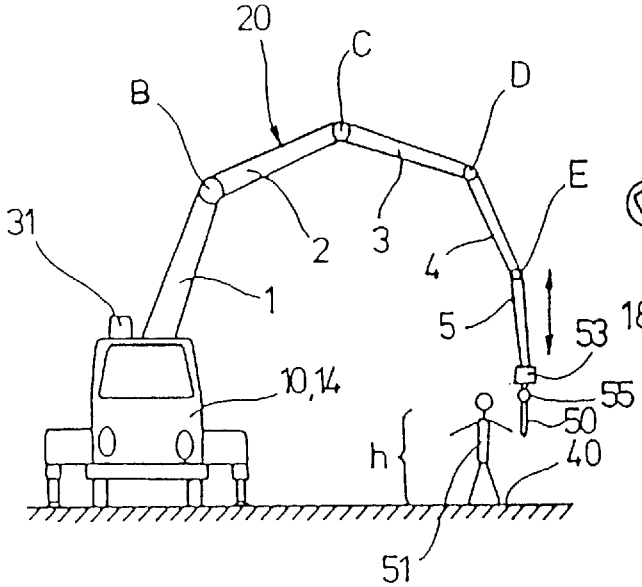
FIGS. 2*a* and *b* are a side view and a top view of a self-propelled concrete pump with an extended jointed mast.
Figure 2B:
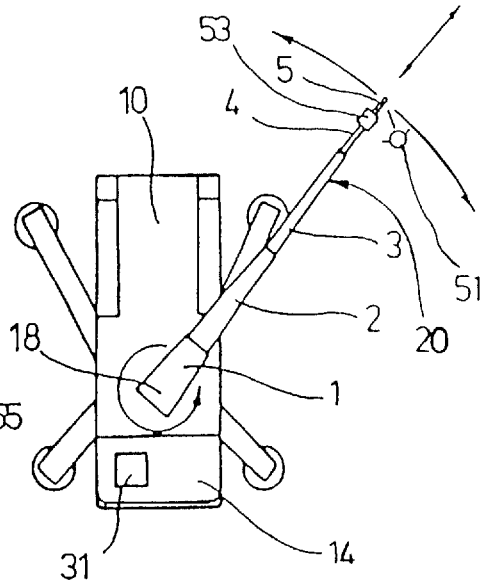

The self-propelled concrete pump illustrated in the drawings has a chassis 10, a mast base 16 arranged near the front axle 12 and the cab 14 of the chassis 10, a rotary head 17, which is rotatable at 360° on the mast base 16 about a vertical axis 18 by means of a hydraulic rotating system and carries a jointed mast 20, a hydraulically driven concrete pump 24, which can be loaded with concrete through a material-feeding container 22, and a conveyor pipeline 28 connected to the concrete pump 24 through a pipe switch 26. The jointed mast 20 has five mast arms 1, 2, 3, 4 and 5, which are pivotally connected with one another at the joint A to the rotary head 17 and at the joints B, C, D and E about each horizontal jointed axes. The collapsing and extending of the mast arms 1 to 5 about the joints A to E is done hydraulically by means of double-acting hydrocylinders 30, which are hinged with their free cylinder-side and rod-side ends to booms or holding bars of the mast arms 1 to 5 and of the rotary head 17. The mast arms are in the travelling position shown in FIG. 1 collapsed against one another in an essentially parallel alignment, whereas they are extended in the illustration according to FIGS. 2*a* and *b*.

A remote-control device is provided for operating the driving systems 30 of the jointed mast 20, which device includes a signal transmitter 53 and a vehicle-fixed central control 31, which communicates galvanically or wirelessly with the signal transmitter 53. A control member 52, 54 is provided to adjust the top of the mast 55 and the end hose 50. The control member 52, 54 is mechanically connected to or communicates wirelessly with the signal transmitter 53, and is moved by the operator 51 directly over the desired displacement path of the mast top 55.

Figure 3:
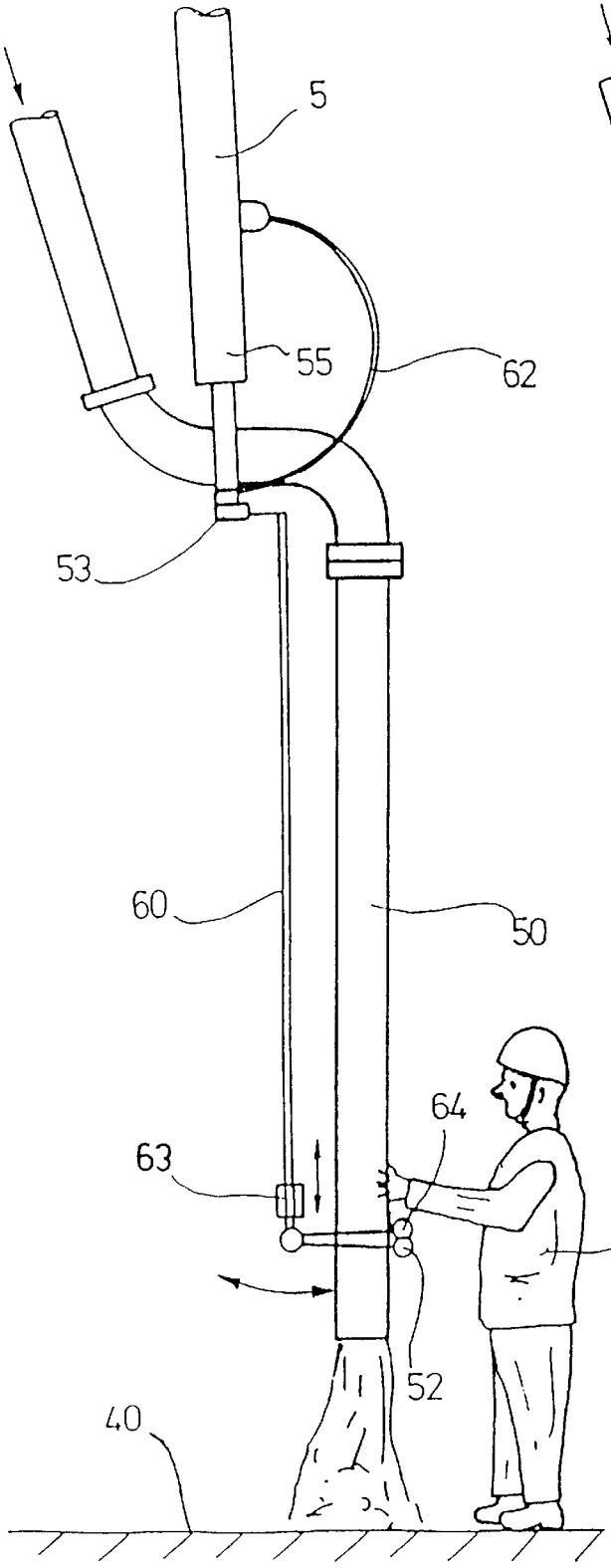
FIG. 3 shows a section of the jointed mast according to FIG. 2*a* with a mechanically operated remote-control device arranged at the top of the mast.

The control member 52 is, in the exemplary embodiment illustrated in FIG. 3, designed as a sensor ring mechanically connected through a plastic rod 60 to the signal transmitter 53 arranged at the mast top 55 and surrounding the end hose 50 with clearance. The signal transmitter 53 is thereby designed advantageously as an analogue-proportionally operating cardanic angle indicator, which is connected to the central control device 31 through a control cable 62. A vertically movable, analogue-proportionally operating tumble switch 63 is arranged in the lower area of the plastic rod 60 in the illustrated exemplary embodiment. The switch 63 can trigger a vertical adjustment of the mast top 55. The elevation-adjusting switch 63 can also be arranged at the upper end of the plastic rod 60 and can be operated by lifting and lowering of the plastic rod. This arrangement is subjected to little danger of damage during rough building-site operations.

In addition, it is possible to arrange a switch 64 on the sensor ring 52 for turning the concrete pump on and off and for controlling the amount to be transported.

Figure 4:
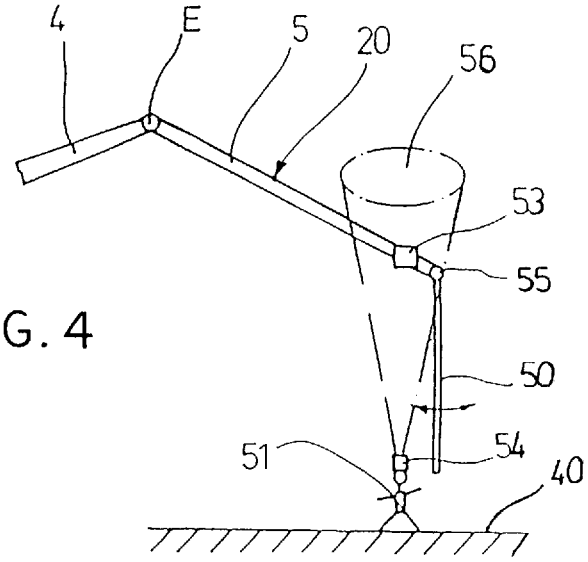
FIG. 4 shows a section corresponding to FIG. 3 with a wirelessly operated remote-control device.

The exemplary embodiment illustrated in FIG. 4 provides a wireless, direction-sensitive signal-transmitting path, for example, a Laser-light or infrared path, between the control member 54 and the signal transmitter 53. For this path, the control member 54 is designed as a transmitter for use in the hand or on the helmet of the operator 51. The transmitter emits a narrow, upwardly pointing directional cone 55 with a varying intensity distribution, which can be evaluated through the receiver 53 and the control device 31 for adjusting the mast top 55. Also the jointed mast 20 follows, with its mast top 55, a movement of the operator 51 parallel to the horizontal plane 40.

Figure 5:
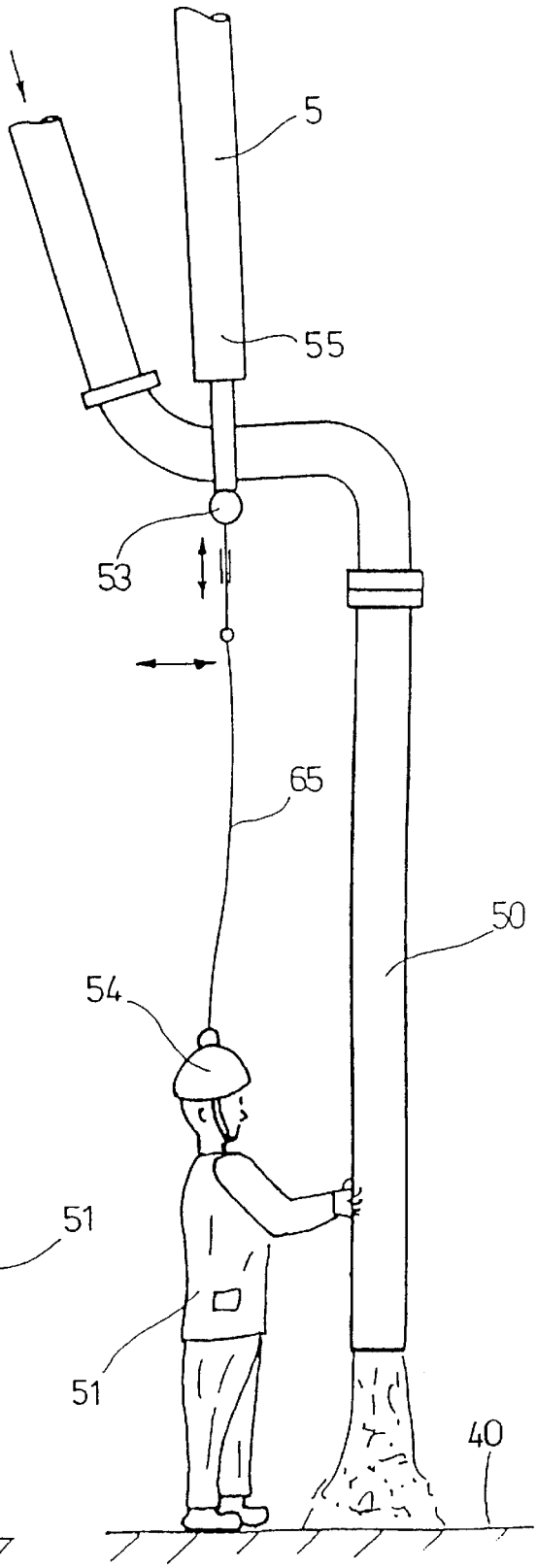
FIG. 5 shows a section corresponding to FIG. 3 with a rope-operated remote-control device.

The exemplary embodiment according to FIG. 5 shows the operator 51 mechanically connected through a rope 65, which is fastened to his helmet 52 or to his body, to the signal transmitter 53 designed as a cardanic angle indicator. The force applied by the movement of the operator 51 through the rope 65 is evaluated according to direction and pull through the signal transmitter 53 and the central control device 31, such that the jointed mast 20 follows with its mast top 55 a movement of the operator parallel to the plane 40.

The additional introduction of a vertical movement is possible both at a mechanical or a wireless signal transmission from the concrete-pouring point through a hand-operated elevation-adjusting element 63. Accordingly, it is also possible to turn the concrete pump on and off from the pouring point with a switch intended therefor.

Corresponding control signals are transmitted to the control device 31 through the signal transmitter 53, when the control member 52 is deflected in the desired direction of movement. The control signals are converted in a data-processing step and by a computer-assisted coordinate transmitter into coordinate signals for the driving systems 30 of the six axes 18, A, B, C, D, E. In addition, it is possible to convert the magnitude of the deflection of the control member 52, 54 through a suitable sensoric or electronic conversion into speed-determining signals. All six axes are controlled with software within the coordinate transmitter in such a manner that the respective joints move harmonically with one another in dependency of the path and time. The control of the redundant degrees of freedom of the joints is done according to a preprogrammed strategy, into which can also be fed collision zones in the form of obstacles, ceilings, built-ins and the like, through the operation software and can be considered in the sequence of movement.

Figure 6:
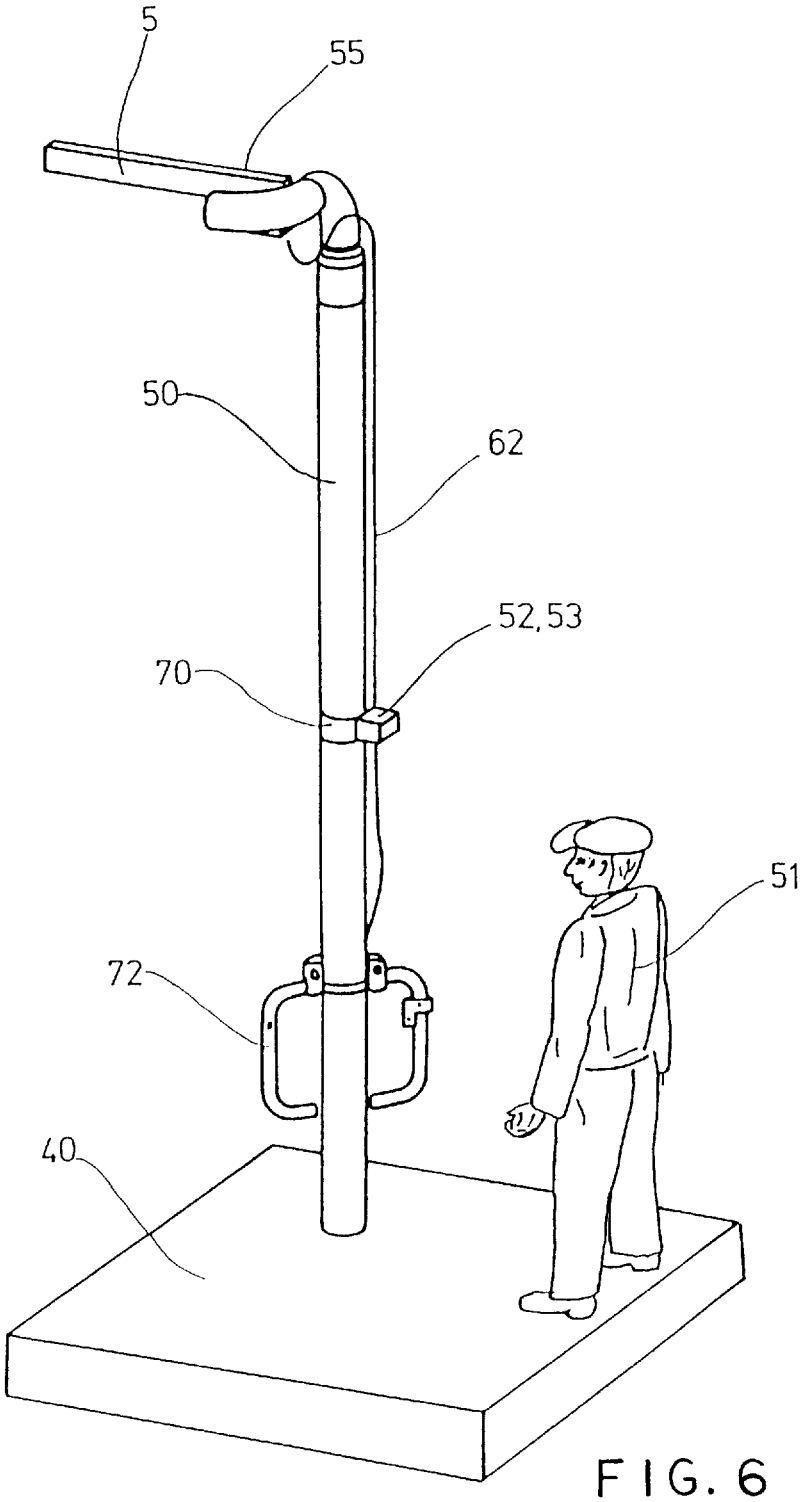
FIG. 6 shows a section of the jointed mast according to FIG. 2*a* with an inclination indicator arranged at the end hose and a handle.
Figures 7A, 7B, 7C, 8A, 8B, 8C:
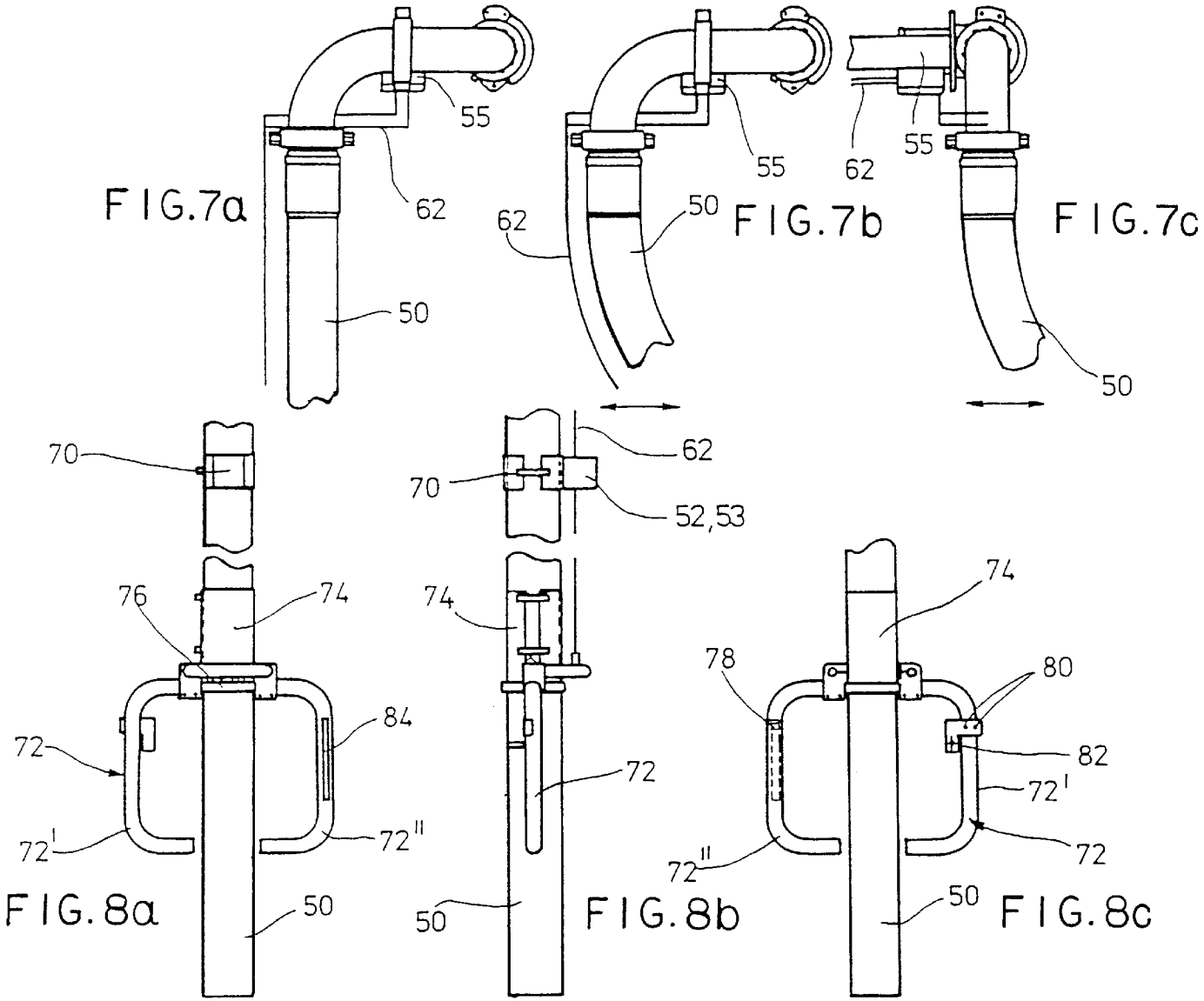
FIGS. 7*a* to *c* are three side views of the mast top with an end-hose section without deflection, with deflection to the left or right and with deflection forward and backward.
FIGS. 8*a* to *c* are three side views of the lower end of the end hose with a handle.

The control member 52 is in the exemplary embodiment illustrated in FIGS. 6 to 8 designed as an inclination indicator. It exists together with the signal transmitter 53 in a small housing, which can be fastened with a bracket 70 fixed against rotation to the end hose 50. The control signals emitted by the inclination indicator 52, 53 are fed through the control cable 62 to the central control 31. The inclination indicator 52, which is designed with two axes, is direction-sensitive. It responds to both lateral deflections of the end hose corresponding to FIG. 7*b* and also to deflections perpendicular thereto corresponding to FIG. 7*c*, and is therefore suited together with the signal transmitter to emit a displacement-path signal dependent on the measured inclination direction. Furthermore, a speed signal dependent on the measured angle of inclination can be produced for moving the mast top 55.

A handle 72 is releasably fastened in the lower part of the end hose 50 by means of a snap bracket 74. The handle 72 consists of two handle parts 72', 72" projecting over the end hose towards diametrically opposed sides. The handle is arranged rotatably at approximately 340° about the end-hose axis so that it can be accessed easily from all sides. If need be, it is also possible to pivot the handle 72 about the axis 76, which extends transversely with respect to the end-hose axis. The handle can additionally be equipped with some switch and control members, for example, a switch 78 to turn the concrete pump on and off, two key elements 80 to adjust the amount to be transported in a positive or negative direction, an elevation-adjusting member 82 designed as an adjusting lever for the end hose 50, and a dead-man switch 84 as a safety measure.

The described process is good for concrete work on precisely structured building sites, in particular, when apparati with a great reach is used.

In conclusion the following is to be stated: The invention relates to a large manipulator, in particular for self-propelled concrete pumps. A rotary head 17 rotatable about a vertical axis of rotation on a mast base 16 and a jointed mast 20 composed of at least three mast arms 1-5 are arranged on a chassis 10. The mast arms 1-5 of the jointed mast 20 are pivotally limited about horizontal, mutually parallel joint axes A to E relative to the respectively adjacent rotary head 17 or mast arm 1-5 by means of the driving systems 30. The jointed mast 20 is operated by a remote-control device which has a signal transmitter 53 arranged at the mast top 55 and can be mechanically released through a control member 52, for controlling a computer-assisted coordinate transmitter, which operates the driving systems 30 of the joint axes and axes of rotation in accordance with a displacement path directly indicated by means of the control member 52 relative to the instantaneous position of the mast top 55.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A method for handling a large manipulator for self-propelled vehicular concrete pumps comprising a concrete-distributing articulated mast arranged on a vehicular frame, the concrete-distributing articulated mast having a freely movable mast top configured to carry a concrete distributing end hose, and a remote-control for manipulating the articulated mast, said method comprising moving the concrete-distributing articulated mast and the mast top with the remote control to a building site, and the operator manually directing the end hose to the desired concrete-feeding point, the mast top automatically following the three-dimensional movements of at least one of the end hose and the operator.

2. The method according to claim 1, wherein the mast top is moved in accordance with the three-dimensional movements of said at least one of the end hose and the operator.

3. The method according to claim 1, wherein the mast top is moved at a constant elevational distance above the concrete-feeding point.

4. The method according to claim 1, wherein the mast top is moved during the deflection of the end hose in a direction corresponding to the direction of deflection of the end hose.

5. The method according to claim 1, wherein the mast top is moved during the deflection of the end hose with a speed dependent on the angle of deflection of the end hose.

6. A concrete pump for mounting on a vehicle having a frame, said pump comprising:

a mast head rotatably mounted on the vehicle frame;

first drive means for rotating said mast head relative to the vehicle frame about a vertical axis in one of a first direction of rotation and a second direction of rotation;

an articulated mast disposed on said mast head and having at least three mast arms pivotable about horizontal axes therebetween, a last mast arm of said at least three mast arms distal said mast head having a freely movable mast top at a distal end thereof and carrying for movement therewith an end hose for distributing concrete;

second drive means for pivoting selected ones of said at least three mast arms about the corresponding horizontal axis;

a computer-assisted coordinate transmitter having means for controlling said first and second drive means and means for storing path-swivel characteristics of said articulated mast;

a remote-control device for operating said first and second drive means, said remote-control device comprising:

a signal transmitter disposed at said mast top and having means for controlling said computer-assisted coordinate transmitter; and a control member disposed at a concrete-feeding location for adjusting the position of said mast top, said control member comprising means for activating said signal transmitter to move said mast top along a displacement path corresponding to movement of at least one of said control member and said end hose by an operator at the concrete-feeding location.

7. A large manipulator for self-propelled vehicular concrete pumps, comprising: a rotary head rotatable about an essentially vertical axis of rotation by means of a first driving system and arranged on a vehicular frame; an articulated mast positioned on said rotary head and being composed of at least three mast arms joined by articulated pivots, and a second driving system for limitedly pivoting selected ones of said mast arms about horizontal and parallel axes of said articulated pivots relative to one of the respective adjacent said rotary head and said mast arm, a last of said at least three mast arms distal said rotary head having a freely movable mast top at a distal end thereof, said mast top carrying for movement therewith an end hose for distributing concrete; and a remote-control device having a control member disposed at a concrete-feeding location for controlling said second driving system and for adjusting the position of said mast top along a predetermined displacement path, said remote-control device having a signal transmitter arranged at said mast top, said signal transmitter being adapted to be one of mechanically, optically, electromagnetically and electrically activated by said control member; and a computer-assisted coordinate transmitter controlled by said signal transmitter for operating said second driving system in accordance with a displacement path directly indicated by means of said control member relative to an instantaneous position of said mast top upon actuation of said control member by an operator at the concrete-feeding location.

8. The large manipulator according to claim 7, wherein said control member comprises a control lever mechanically connected to said signal transmitter, said control lever being adjustable relative to said mast top in various directions indicating the displacement path.

9. The large manipulator according to claim 8, wherein said control lever comprises a sensor ring disposed about said end hose and connected to said signal transmitter by a rod extending therebetween.

10. The large manipulator according claim 7, wherein said control member is mechanically connected to said end hose, with a predetermined spatial clearance.

11. The large manipulator according to claim 7, wherein said control member and said signal transmitter are connected with one another by a direction-sensitive wireless transceiver path.

12. The large manipulator according to claim 11, wherein the direction-sensitive wireless transceiver path comprises one of a light, infrared and radio path.

13. The large manipulator according to claim 11, wherein said signal transmitter includes a laser diode and said control member includes a direction-sensitive light receiver.

14. The large manipulator according claim 7, wherein said control member is fixed to one of said end hose and a body part of an operator and is manually activated by the operator.

15. The large manipulator according to claim 7, wherein the control member comprises a direction-sensitive inclination indicator, said inclination indicator being at least one of releasably and elevationally adjustably arranged on said end hose.

16. The large manipulator according to claim 15, wherein said control member comprises a biaxial inclination indicator.

17. The large manipulator according to claim 15, wherein said inclination indicator has evaluating electronics with one of an integrated and after-arranged said signal transmitter for emitting at least one of a displacement-path signal depending on the measured direction of inclination and a speed signal depending on the measured angle of inclination for the movement of said mast top.

18. The large manipulator according claim 15, wherein said inclination indicator together with said signal transmitter is arranged in a housing non-rotatably fastened to said end hose.

19. The large manipulator according claim 7, further comprising a handle pivotally arranged about at least one of a longitudinal axis of said end hose and an axis extending transversely with respect to the end hose axis.

20. The large manipulator according to claim 19, wherein said handle has two handle parts diametrically opposite one another for operation by both hands of the operator.

21. The large manipulator according to claim 19, further comprising at least one of: means disposed on said handle for switching a concrete pump on or off; means disposed on said handle for adjusting the amount of concrete to be transported; and means disposed on said handle for lifting and lowering said mast top.

22. The large manipulator according to claim 19, further comprising a dead-man switch disposed on said handle.

23. The large manipulator according to claim 7, wherein said second driving system is controlled by means of said coordinate transmitter while maintaining a constant height of said mast top above a horizontal plane.

24. The large manipulator according to claim 7, further comprising a manually operated elevation-adjusting element for adjusting the height of said mast top.

25. The large manipulator according to claim 24, wherein said elevation-adjusting element comprises a double-throw switch with a defined zero position, said switch reacting to a lifting and lowering force engaging said control member.

26. The large manipulator according to claim 7, wherein the speed of movement of said mast top is controlled in accordance with a deflection range of said control member in a displacement direction relative to a zero position.

27. The large manipulator according to claim 7, wherein said second driving system is operated in accordance with a selected predetermined swivel path characteristic of said articulated mast stored in said coordinate transmitter.

28. The large manipulator according to claim 27, wherein the swivel path characteristic in said coordinate transmitter is modifiable in accordance with at least one of load-dependent bending and torsion moments engaging each said mast arm.

29. The large manipulator according to claim 27, wherein the swivel path characteristic in said coordinate transmitter is modifiable in accordance with collision zones, spatially limiting the movements of said mast arms, by indicating at least one of a highest and lowest articulated pivot.

30. The large manipulator according to claim 27, wherein the swivel path characteristic in said coordinate transmitter is modifiable in accordance with measuring signals emitted by a distance sensor arranged on said last mast arm.

* * * * *